United States Patent [19]

Kohal

[11] Patent Number: 4,662,251

[45] Date of Patent: May 5, 1987

[54] ORTHOGONAL ADJUSTABLE SOCKET WRENCH

[76] Inventor: Lester L. Kohal, Rte. 1, Box 222, Searcy, Ark. 72143

[21] Appl. No.: 785,396

[22] Filed: Oct. 8, 1985

[51] Int. Cl.[4] ..... B25B 13/00

[52] U.S. Cl. ..... 81/58; 81/60; 81/177.9

[58] Field of Search ..... 81/58, 58.4, 60–63.2, 81/177.7, 177.8, 177.9

[56] References Cited

U.S. PATENT DOCUMENTS

| | | | |
|---|---|---|---|
| 1,320,137 | 10/1919 | Gunn | 81/62 |
| 2,800,821 | 7/1957 | Fruscella | 81/60 |
| 2,977,824 | 4/1961 | Rueb | 81/177.8 X |
| 3,186,265 | 6/1965 | Wenturine | 81/177.9 |
| 4,108,027 | 8/1978 | Lenker | 81/60 |

*Primary Examiner*—Frederick R. Schmidt
*Assistant Examiner*—Maurina Rachuba
*Attorney, Agent, or Firm*—Cushman, Darby & Cushman

[57] ABSTRACT

An adjustable socket wrench in which the ratchet head is orthogonally pivotable with respect to the wrench handle. A ratchet housing is integral with one end of the handle and has a substantially circular hole therein. The hole has a partially spherical interior surface with first and second flat portions on opposite sides of the hole so that the flat portions are substantially parallel to the longitudinal axis of the handle. A ratchet head is mounted within the hole and has a partially spherical exterior surface which movably fits within the ratchet housing interior surface. The exterior surface has third and fourth flat portions which slidably abut the first and second flat portions. The ratchet head is pivotable within the ratchet housing about an axis orthogonal to the flat portions and perpendicular to the longitudinal axis of the handle. A conventional ratchet device is mounted within the ratchet head and has a drive member which is movable, with a ratchet action, with respect to the ratchet head.

20 Claims, 7 Drawing Figures

ORTHOGONAL ADJUSTABLE SOCKET WRENCH

BACKGROUND OF THE INVENTION

This invention relates to the field of socket wrenches, and more particularly to a socket wrench having a ratchet head which is ortogonally pivotable with respect to the wrench handle so that the wrench handle may be adjusted at an angle with respect to the surrounding work surface.

The well-known socket wrench is used in all areas of our technological society. However, it is difficult for known wrenches to be used in tight spaces, particularly where surface obstructions are located adjacent to the nut or bolt which is to be driven. It is known to use extension rods which allow the socket wrench to be vertically displaced above the working surface so as to avoid the aforementioned surface obstructions. However, such extension rods are subject to breaking and are themselves limited by the space available in the vicinity of the nut or bolt to be driven. Therefore, it would appear to be advantageous to provide a socket wrench in which the ratchet head is made pivotable with respect to the wrench handle so that the ratchet head may be coupled to the nut or bolt while the wrench handle is vertically displaced from the working surface upon which the nut or bolt is mounted.

Such a wrench was proposed in U.S. Pat. No. 1,320,137 to Gunn. Gunn provides a wrench handle with a yoke extending from one end thereof. The ratchet head includes two trunions which are mounted on opposite sides of the yoke so that the ratchet head is pivotable with respect to the wrench handle. A disadvantage of the wrench according to Gunn is that the yoke does not totally encompass the ratchet head. Thus, when great force is applied to the wrench handle, the yoke is subject to bending and/or breaking due to its structural infirmity. Another disadvantage of the wrench according to Gunn is that the trunions sometimes shear off or are deformed when great force is applied to the wrench handle.

A further disadvantage of the Gunn wrench is that the wrench handle may be pivoted entirely around the ratchet head. Those having skill in the wrench-design field will recognize that once the Gunn wrench handle is pivoted greater than 45° with respect to the working surface, the wrench handle must be twisted with a torque-like action rather than being pushed in a direction perpendicular to the wrench handle. In such circumstances, the mechanical advantage of the wrench is greatly reduced.

A further disadvantage of the wrench according to Gunn is that no means are provided to temporarily fix the angle between the wrench handle and the ratchet head. Applying face to the handle may cause it to pivot entirely over the top of the ratchet head and lose mechanical advantage. Thus, a person using the Gunn wrench may find it extremely difficult to operate since the handle is freely pivotable with respect to the ratchet head. Thus, Gunn provides no temporary fixing means by which the angle between the wrench handle and the ratchet head may be temporarily fixed at the most advantageous position.

Another wrench with a pivotable ratchet head was proposed in U.S. Pat. No. 2,977,824 to Rueb. In Rueb, the ratchet handle is a split handle with a yoke-like portion extending on each side of the split. The ratchet head is mounted by trunions to each of the yoke-like portions. Like Gunn, the Rueb wrench is subject to bending at the yoke-like portions and shearing off or breaking the trunions. Also, Rueb provides no means for limiting the pivot angle of the ratchet head with respect to the handle, nor temporary fixing means by which the pivot angle may be temporarily fixed at a desired angle.

Another wrench with a pivotable handle was proposed in U.S. Pat. No. 3,186,265 to Wenturine et al. However, the Wenturine wrench pivots the handle with respect to the ratchet housing and thus, the pivot axis does not pass through the ratchet head. Such an arrangement reduces the mechanical advantage which can be obtained by providing the pivot axis through the ratchet head. Like the Gunn and Rueb devices, the Wenturine wrench pivots about a pin (trunions) which is subject to shearing under great load.

Therefore, there is a need for an orthogonally adjustable socket wrench in which the ratchet head is pivotable with respect to the wrench handle, and wherein the structure will not be easily broken or damaged by the application of great force to the wrench handle. In addition, such a wrench should provide stopping means by which the angle between the ratchet head and the wrench handle may be prevented from exceeding 45°. Also, such a wrench should provide means for temporarily fixing the angle between the ratchet head the wrench handle at a desired operating angle.

SUMMARY OF THE INVENTION

The object of the present invention is to overcome the above-discussed disadvantages of known wrenches and to provide an adjustable socket wrench providing durability, sufficient mechanical advantage, and operability in a wide variety of working environments.

These and other objects are met by providing an adjustable socket wrench having a handle with an end and a longitudinal axis. A ratchet housing is formed integral with the handle end and has a substantially circular hole therein. The hole has a partially spherical interior surface with first and second flat portions located on opposite sides of the hole on an axis perpendicular to the longitudinal axis of the handle. A ratchet head is mounted within the hole and has a partially spherical exterior surface which movably fits within the ratchet housing interior surface. The ratchet head exterior surface has third and fourth flat portions which slidably abut the first and second flat portions of the ratchet housing. The ratchet head may pivot within the ratchet housing by rotation about the axis passing through the flat portions. A ratchet device is then mounted within the ratchet head and includes the well-known reversible ratchet drive.

A wrench according to the present invention may also include pivot-arresting means including a circumferential detent on the exterior surface of the ratchet head, and a detent engaging means mounted on the interior surface of the ratchet housing. Such a wrench may also provide temporary fixing means including a plurality of detents located on the exterior surface of the ratchet head, and a biased detent engaging device which selectively engages one of the plurality of detents to temporarily fix the angle between the wrench handle and the ratchet head.

BRIEF DESCRIPTION OF THE DRAWINGS

The advantageous features of the present invention may be readily understood from the following detailed description of the presently preferred exemplary embodiment, taken together with the drawings in which.

DETAILED DESCRIPTION OF THE PRESENTLY PREFERRED EXEMPLARY EMBODIMENT

Figure 1:
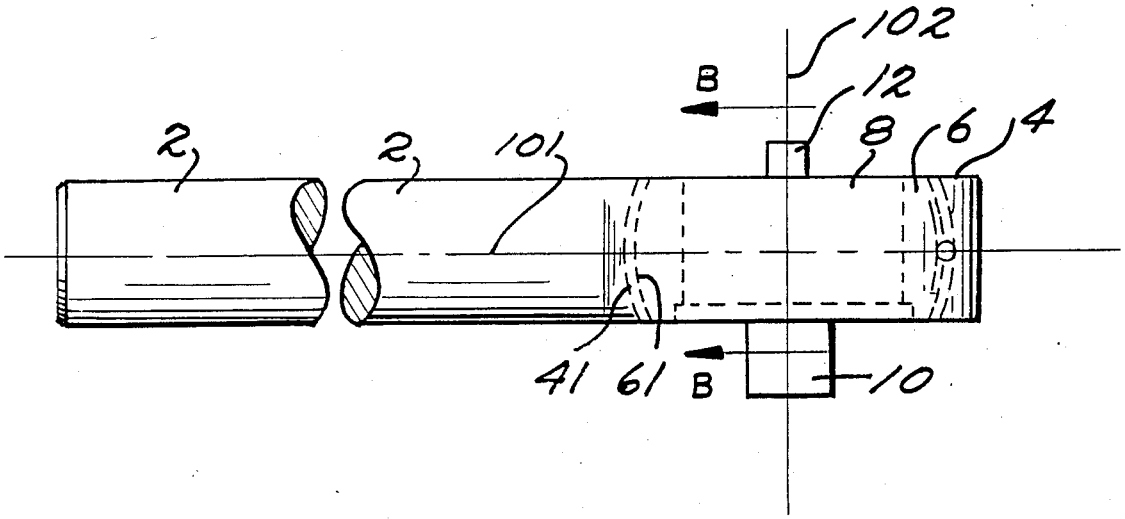
FIG. 1 shows a side view of the wrench according to the present invention.
Figure 2:
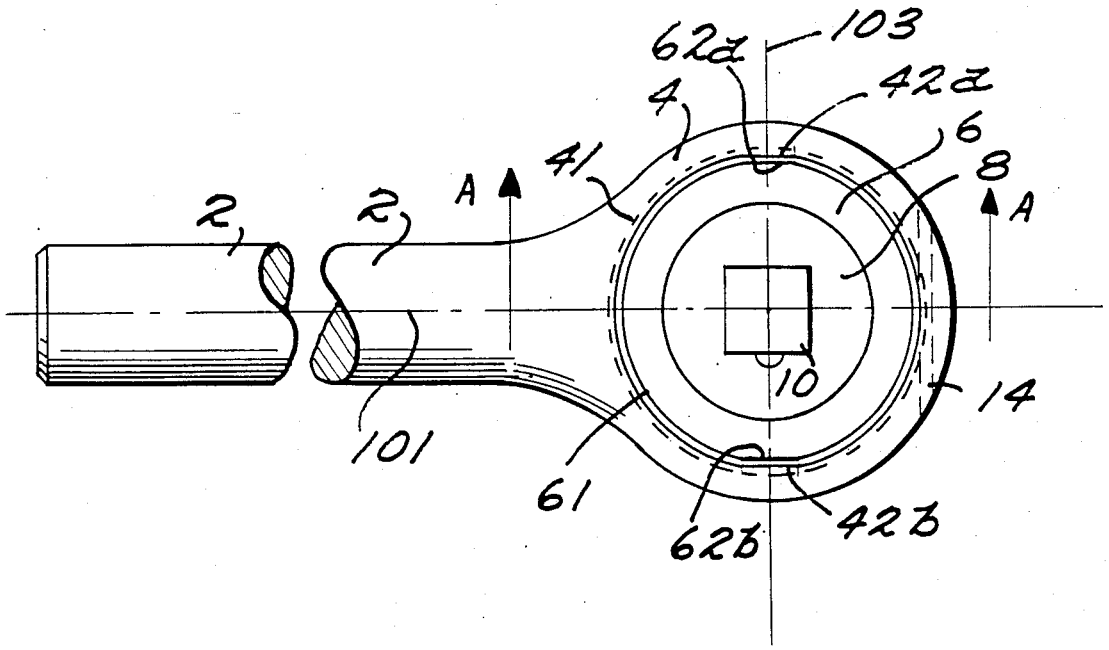
FIG. 2 shows a bottom plan view of the wrench according to FIG. 1.

Referring to FIGS. 1 and 2, it can be seen that wrench handle 2 has a longitudinal axis 101 extending therethrough. Ratchet housing 4 extends from and is integral with wrench handle 2. Ratchet housing 4 has a circular hole therein, about axis 102. The inside of the hole has an interior surface 41 which is partially spherical in shape. On opposite sides of interior surface 41 are two flat portions 42*a* and 42*b* which are orthogonally intersected by axis 103. Axis 103 is the ratchet head pivot axis.

Within ratchet housing 4 is disposed a ratchet head 6 which is generally circular in shape and has an exterior surface 61 which is also partially spherical in shape. Exterior surface 61 movably fits within interior surface 41 of ratchet housing 4. Ratchet head 6 also has flat portions 62*a* and 62*b* which abut flat portions 42*a* and 42*b*, respectively. Thus, as ratchet head 6 pivots within ratchet housing 4, flat portions 62*a* and 62*b* rotate about axis 103 and slidably abut flat portions 42*a* and 42*b* as bearing surfaces. During such pivoting, exterior surface 61 rotates within interior surface 41.

Within ratchet head 6, is mounted a ratchet device 8 which includes drive member 10 and ratchet lever 12. Drive member 10 is adapted to be coupled to various wrench sockets and other well-known tools. Ratchet lever 12 is used to reverse the ratchet action of ratchet device 8 in a well-known manner. Thus, the ratcet device can be adjusted so that drive member 10 rotates in a clockwise or counterclockwise direction with respect to ratched head 6.

In operation, when force is applied to wrench handle 2, the turning force is transmitted to drive member 10 by the flat surfaces 42*a*–62*a*, 42*b*–62*b*, in conjunction with and supported by interior surface 41 and exterior surface 61. Thus, the force transmitted through the flat portions is spread across a very wide area and is not concentrated at small stress points. By spreading the force over a large area, deformation and failure of the wrench is prevented.

Figure 3:
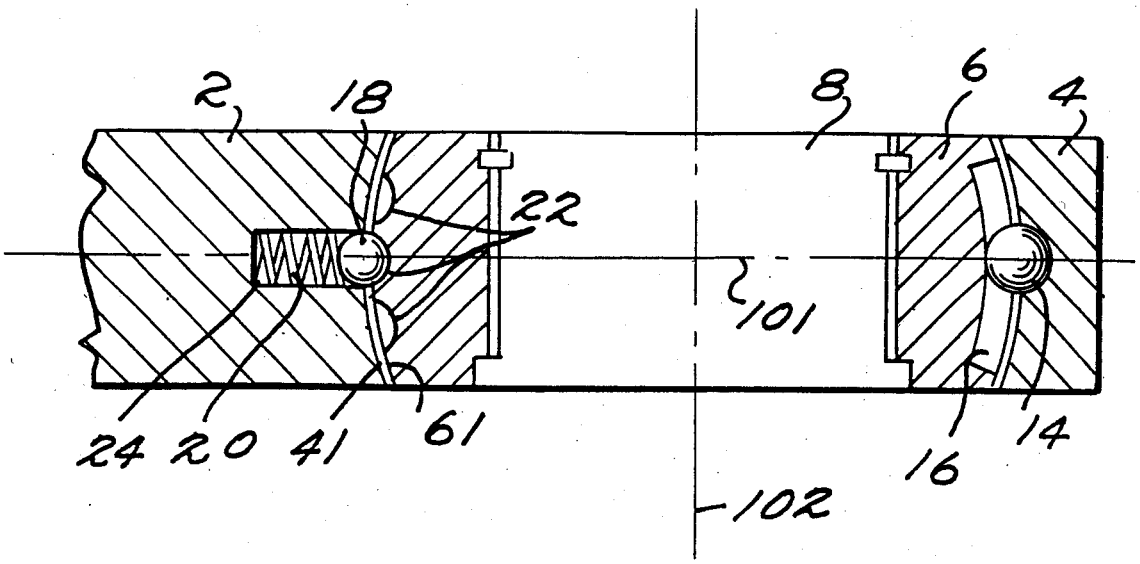
FIG. 3 is a cross-sectional view taken along section A—A of FIG. 2.

Referring now to FIG. 3, a more detailed view of ratchet housing 4 and ratchet head 6 is provided. Interior surface 41 and exterior surface 61 are designed to fit together with a tolerance which allows easy movement but also provides support for the forces imparted from wrench handle 2 to the ratchet device 8. Preferably, the tolerance between interior surface 41 and exterior surface 61 is 0.01 inch.

As discussed in the Background portion, it is desirable to prevent ratchet head 6 from pivoting beyond 45° with respect to ratchet housing 4. Thus, the pivot angle between the ratchet head 6 and the rachet housing 4 should be limited to 45°. In actual practice, the inventor has discovered that it is preferable if this pivot angle is limited to ±30°. A 30° limitation ensures that the majority of force applied to wrench handle 2 is transmitted as torque in drive member 10.

To prevent the pivot angle from exceeding 30°, ratchet housing 4 includes a cylindrical pin 14 tangentially mounted within the hole in ratchet housing 4 so as to be parallel with axis 103 (see FIG. 2). Pin 14 is fixed in ratchet housing 4. Ratchet head 6 has a circumferential detent 16 which co-acts with pin 14 to prevent the pivot angle from exceeding 30°. Actually, circumferential detent 16 may be configured to limit the pivot angle at any pre-selected angle. Cylindrical pin 14 is preferably a $\frac{1}{8}$ inch pin which provides the requisite strength and stability.

As discussed in the Background section, it is preferable that means be provided to temporarily fix the angle between ratchet head 6 and ratchet housing 4 so that stability may be provided for the operator and so that the majority of force applied to wrench handle 2 is properly transmitted to drive member 10. To perform such a function, the present invention provides a ball 18 which is biased by spring 20 into one of a plurality of detents 22. Thus, as ratchet head 6 is rotated about ratchet housing 4, ball 18 is forced into one of the detents 22 by spring 20. With ball 18 engaged in one of detents 22, the wrench handle is no longer free to pivot about the ratchet head. This ensures a temporary fixing of the pivot angle so that stability may be provided in the application of force to the pivoted ratchet head.

Preferably, spring 20 is mounted within a cylindrical hole 24 which extends through ratchet housing 4 into wrench handle 2. Preferably, cylindrical hole 24 is $\frac{1}{8}$ inch in diameter by $\frac{3}{8}$ inch long. It is also preferable that ball 18 be staked in place to prevent its becoming lost when ratchet head 6 is removed from ratchet housing 4.

In the presently preferred exemplary embodiment, there are three detents 22 which are so located on exterior surface 61 that ratchet head 6 can be temporarily fixed at angles of 0°, −10°, and +10° with respect to ratchet housing 4. Those having skill in the tool design field will recognize that the number and positioning of detents 22 may be at angles of 10°, 20°, 30°, or varied depending on the application for which the tool is designed.

Figure 4:
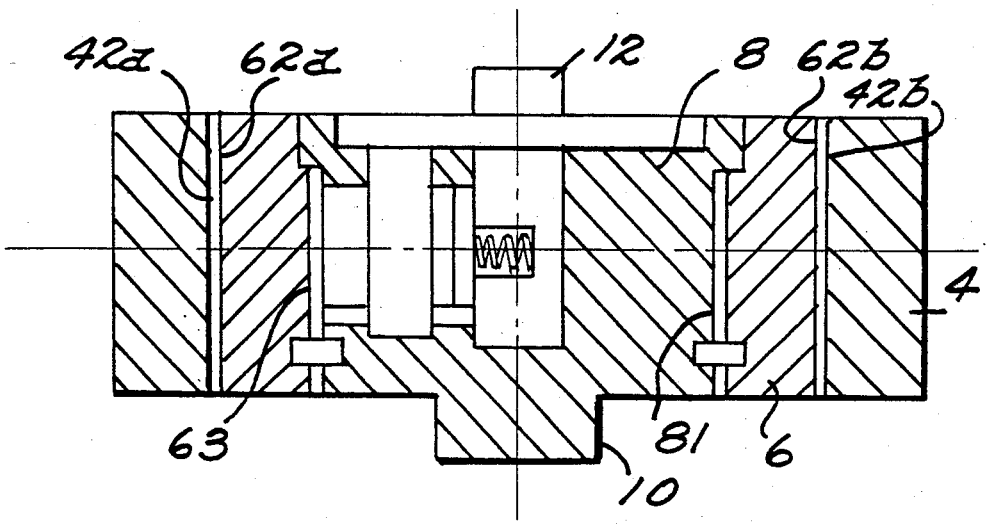
FIG. 4 is a cross-sectional view taken along section B—B FIG. 1.

FIG. 4 depicts an end view of the present invention taken along section B—B of FIG. 1. It can be seen that flat portions 62*a* and 62*b* slidably abut against flat portions 42*a* and 42*b*. The preferable tolerance between these flat portions is also 0.01 inch. The conventional features of ratchet device 8 are also depicted in FIG. 4. It can be seen that ratchet device 8 has an interior surface 81 which is movable with respect to an interior surface 63 of ratchet head 6. Interior surface 63 is also used to engage the ratchet teeth of ratchet device 8.

Figure 5:
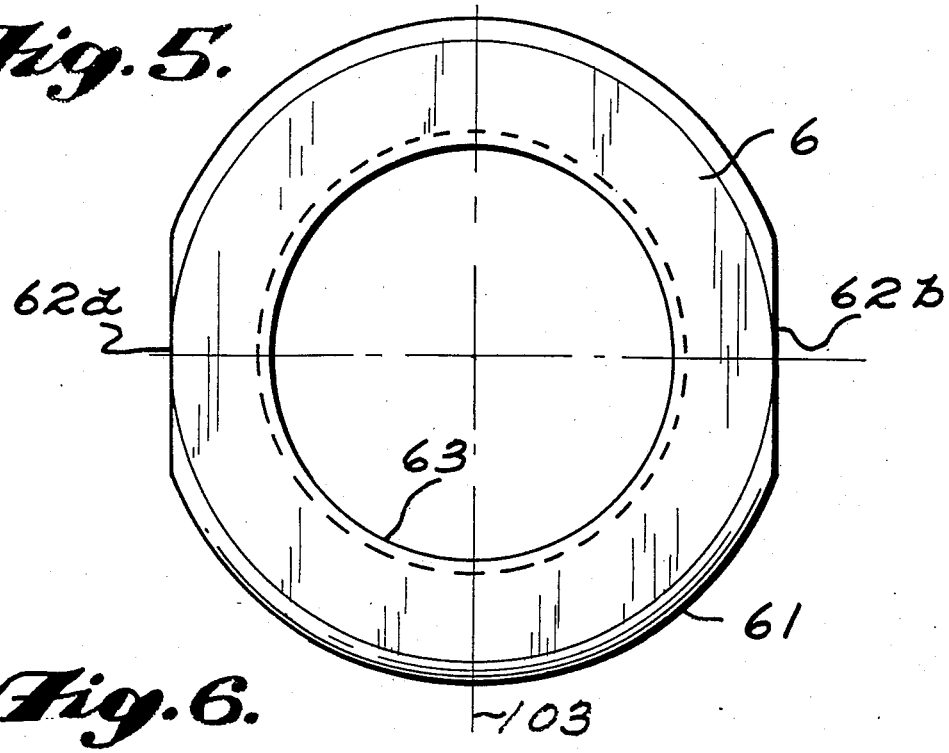
FIG. 5 is a plan view of the ratchet head.
Figure 6:
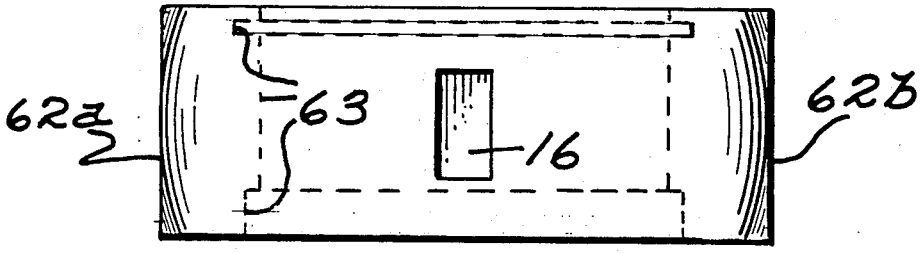
FIG. 6 is a side view of the ratchet head of FIG. 5.
Figure 7:
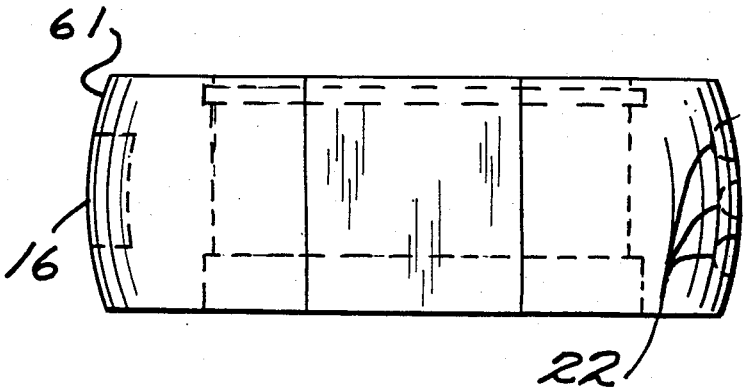
FIG. 7 is an end view of the ratchet head of FIG. 5.

FIGS. 5, 6, and 7 depict the configuration of ratchet head 6. Ratchet head 6 is preferably 1.5 inches in diameter at the partially spherical surface, and 1.406 inches in width from flat portion 62*a* to flat portion 62*b*. Interior surface 63 of ratchet head 6 varies in diameter to accommodate the mounting of ratchet device 8 therewithin.

Circumferential detent 16 is pictured in FIG. 6 as being a rectangular hole $\frac{1}{8}$ inch wide by $\frac{3}{8}$ inch high in the exterior surface 61. The depth of circumferential detent 16 may vary depending on the curvature of exterior surface 61, but should average 3/32 inches. These dimensions will ensure a suitable engagement between circumferential detent 16 and cylindrical pin 14.

FIG. 7 depicts temporary fixing detents 22 on the opposite side of ratchet head 6 from circumferential detents 16. Preferably, detents 22 are 1/16 inch in diameter.

Thus, what has been described is an adjustable socket wrench in which the ratchet head is pivotable about an axis perpendicular to the longitudinal axis of the wrench handle. By making the wrench head pivot about flat portions on the ratchet head and in the ratchet housing, the wrench is capable of withstanding greater forces than prior art devices which utilize trunions or pins. By enclosing the ratchet head totally within the ratchet housing, additional structural strength and stability is provided. The pivot angle between the ratchet head and the ratchet housing may be limited to less than 45° to ensure proper application of force with the requisite mechanical advantage. Temporary fixing means may be provided to temporarily fix the pivot angle at a predetermined angle. Thus, this adjustable wrench is capable of being used in a wide variety of working environments and over a wide range of applied forces.

While this invention has been described in connection with what is presently considered to be the most practical and preferred embodiments, it is understood that the invention is not to be limited to the disclosed embodiment but, on the contrary, is intended to cover various modifications and equivalent arrangements included within the spirit and scope of the appended claims, which scope is to be accorded the broadest interpretation so as to encompass all such modifications and equivalent structures.

I claim:

1. A wrench comprising:

a handle having an end and a longitudinal axis;

a ratchet housing integral with said handle end and having a substantially circular hole with an axis perpendicular to said longitudinal axis, said hole having a partially spherical interior surface with first and second flat portions on opposite sides of said hole so as to be substantially parallel to said longitudinal axis, a ratchet head mounted within said hole and having a partially spherical exterior surface which movably fits within said ratchet housing interior surface, said exterior surface having third and fourth flat portions slidably abutting said first and second flat portions, respectively, to cause said ratchet head to be pivotable, with respect to said handle, about an axis passing orthogonally through said flat portions; and a ratchet device mounted within said ratchet head and having a drive member movable with a ratchet action with respect to said ratchet head.

2. A wrench according to claim 1 wherein said ratchet head exterior surface has a pivot arresting detent and wherein said ratchet housing interior surface has first detent engaging means for engaging said pivot-arresting detent to limit the pivot of said ratchet head to less than or equal to ±45° with respect to said longitudinal axis.

3. A wrench according to claim 2 wherein said ratchet head exterior surface has a plurality of positioning detents, and wherein said ratchet housing interior surface has second detent engaging means for selectively engaging one of said positioning detents to temporarily fix a pivot angle of said ratchet head at one of a plurality of predetermined angles with respect to said longitudinal axis.

4. A wrench according to claim 3 wherein said second detent engaging means includes an engaging member which is biased toward said positioning detents.

5. A wrench according to claim 4 wherein said engaging member includes a ball and is biased by a spring which extends through said ratchet head into said handle.

6. A wrench according to claim 3 wherein said pivot-arresting detent and said first detent engaging means are on opposite sides of said ratchet head and said ratchet housing from said positioning detents and said second detent engaging means.

7. A wrench according to claim 3 wherein said second detent engaging means includes a cylindrical pin mounted parallel to the pivot axis.

8. A wrench according to claim 3 wherein the pivot of said ratchet head is limited to ±30° with respect to said longitudinal axis.

9. A wrench according to claim 3 wherein said plurality of detents includes first, second and third detents for temporarily fixing said ratchet head at substantially 0°, −10°, and +10° with respect to said longitudinal axis.

10. A wrench according to claim 1 wherein said ratchet device includes a ratchet lever for selectively switching said ratchet action between a clockwise and a counterclockwise ratchet action.

11. An orthogonally adjustable socket wrench comprising:

a handle having an end and a longitudinal axis;

a ratchet housing integral with said handle end and having a partially spherical interior surface, said interior surface having first and second flat portions located on opposite sides of said interior surface so as to be substantially parallel to said longitudinal axis;

a ratchet head located within said ratchet housing and having (a) a partially spherical exterior surface which movably fits within said ratchet housing interior surface, (b) third and fourth flat portions slidably abutting said first and second flat portions, respectively, (c) a plurality of detents on a side adjacent said handle, and (d) a circumferential detent on a side opposite said handle, said ratchet head being pivotable about an axis passing orthogonally through said flat portions;

first detent engaging means mounted on said ratchet head interior surface, for engaging said circumferential detent and limiting the pivot of said ratchet head to substantially ±45° with respect to said longitudinal axis;

second detent engaging means mounted on said handle, for selectively engaging said plurality of detents to cause said ratchet head to be temporarily fixed at selected angles with respect to said longitudinal axis; and a ratchet device mounted within said ratchet head and having a drive member rotatable, with a ratchet action, with respect to said ratchet head.

12. A wrench according to claim 11 wherein said plurality of detents includes first, second, and third detents for temporarily fixing said ratchet head at substantially 0°, +10°, and −10°, respectively, with respect to said longitudinal axis.

13. A wrench according to claim 12 wherein said plurality of detents further includes fourth and fifth detents for temporarily fixing said ratchet head at substantially +20° and −20°, respectively, with respect to said longitudinal axis.

14. A wrench according to claim 13 wherein said plurality of detents further includes sixth and seventh detents for temporarily fixing said ratchet head at substantially +30° and −30°, respectively, with respect to said longitudinal axis.

15. A wrench according to claim 11 wherein said first detent engaging means includes a cylindrical pin having a longitudinal axis parallel to the pivot axis.

16. A wrench according to claim 11 wherein said second detent engaging means includes a ball biased to engage one of said plurality of detents.

17. A wrench according to claim 11 wherein said ratchet head pivot is limited to ±30° with respect to said longitudinal axis.

18. A wrench according to claim 11 wherein said ratchet device includes a ratchet lever by which said drive member may selectively be rotated in one of a clockwise and a counterclockwise direction with respect to said ratchet head.

19. A wrench according to claim 11 wherein a gap between said interior surface and said exterior surface is substantially 0.01 inch.

20. A wrench having a pivotable ratchet head comprising:

a handle having an end and a longitudinal axis;

a ratchet housing integral with said handle end and having a hole with an axis perpendicular to said longitudinal axis, said hole having a partially spherical interior surface with first and second flat portions on opposite sides of said hole so as to be substantially parallel to said longitudinal axis, said ratchet housing including (a) a pin mounted on a side opposite said handle, (b) a spring-biased ball mounted on a side adjacent said handle and (c) a spring to bias said ball;

a ratchet head located within said hole and having (a) a partially spherical exterior surface which movably fits within said ratchet head exterior surface, (b) third and fourth flat portions which slidably engage said first and second flat portions, respectively, to allow said ratchet head to pivot about an axis passing orthogonally through said flat portions, (c) a pivot-arresting detent engaging said pin to limit said ratchet head pivot to ±30° with respect to said longitudinal axis, and (d) first, second, and third detents selectively engageable with said spring-biased ball to temporarily fix said ratchet head pivot at first, second and third redetermined angles respectively, with respect to said longitudinal axis; and a ratchet device integral with said ratchet head and having a drive member movable, with a ratchet action, with respect to said ratchet head.

* * * * *